US008069748B1

(12) United States Patent
Closs

(10) Patent No.: US 8,069,748 B1
(45) Date of Patent: Dec. 6, 2011

(54) XY LINEAR SLIDE MECHANISM

(75) Inventor: Daniel A. Closs, Besigheim (DE)

(73) Assignee: Prefix Corporation, Rochester Hills, MI (US)

( * ) Notice: Subject to any disclaimer, the term of this patent is extended or adjusted under 35 U.S.C. 154(b) by 867 days.

(21) Appl. No.: 12/125,111

(22) Filed: May 22, 2008

Related U.S. Application Data

(60) Provisional application No. 60/939,936, filed on May 24, 2007.

(51) Int. Cl.
*G05G 11/00* (2006.01)

(52) U.S. Cl. ..... 74/490.09

(58) Field of Classification Search ..... 74/490.09; 33/1 M; 108/20, 137, 143; 248/661, 913; 384/7, 9; 359/393
See application file for complete search history.

(56) References Cited

U.S. PATENT DOCUMENTS

| | | | |
|---|---|---|---|
| 4,425,508 | A | 1/1984 | Lewis, Jr. et al. |
| 4,756,089 | A | 7/1988 | Danielsson, III |
| 4,848,004 | A | 7/1989 | Wilkins |
| 4,888,877 | A | 12/1989 | Enderle et al. |
| 5,309,847 | A | 5/1994 | Matsumoto |
| 5,724,893 | A | 3/1998 | Lee et al. |
| 5,933,933 | A | 8/1999 | Fritz et al. |
| 6,030,126 | A | 2/2000 | Hochhausl |
| 6,302,585 | B1 | 10/2001 | Lee et al. |
| 6,452,131 | B2 | 9/2002 | Britnell |
| 6,648,509 | B2 | 11/2003 | Watson |
| 2003/0094059 | A1 | 5/2003 | Higuchi et al. |
| 2004/0149067 | A1 | 8/2004 | Pahk et al. |
| 2005/0017823 | A1 | 1/2005 | Sakano et al. |
| 2005/0178230 | A1 | 8/2005 | Wattyn |

FOREIGN PATENT DOCUMENTS

JP 05281110 A * 10/1993

* cited by examiner

*Primary Examiner* — Thomas R Hannon
*Assistant Examiner* — Phillip A Johnson
(74) *Attorney, Agent, or Firm* — Young, Basile, Hanlon & MacFarlane, P.C.

(57) ABSTRACT

An X-Y linear slide mechanism includes a first block member having opposing exterior and interior surfaces, a second block member having a planar interior surface, a pair of cylindrical rods secured together along their axial lengths. The interior surfaces of the first and second block members each have elongate grooves formed therein. The elongate grooves have a length longer than the pair of cylindrical rods, a width to receive one of the cylindrical rods and a depth slightly greater than the diameter of one of the cylinder rods. Each of the pair of cylindrical rods are disposed in one of the elongate grooves providing X and Y linear motion of the second block member relative to the first block member.

12 Claims, 2 Drawing Sheets

XY LINEAR SLIDE MECHANISM

This application claims priority of U.S. provisional patent application Ser. No. 60/939,936 filed on May 24, 2007 herein incorporated in its entirety by reference.

FIELD OF THE INVENTION

The invention relates to an X-Y linear slide mechanism.

BACKGROUND

X-Y linear slides mechanisms are well known in the industry where two dimensional precise movement is needed to position an object supported on the mechanism. One application of such a precision motion device is an X-Y stage used in the lithography equipment for the manufacturer of semiconductor integrated devices. The X-Y stage provides position control in two linear directions. And in lithography equipment, during the manufacturer of semi-conductor integrated devices, the X-Y stage contributes to positioning either a reticle or a semi-conductor wafer.

SUMMARY

In accordance with the present invention, the novel X-Y linear slide mechanism is provided having a first block member with a planar exterior surface and an opposing planar interior surface; and a second block member having a planar interior surface, wherein each of the planar interior surfaces have an elongate groove formed therein. A pair of cylinder rods are secured to each other along their axial lengths and disposed within the elongate grooves. The pair of cylinder rods support the second block member. The elongate grooves are configured for receiving one of the cylindrical rods, permitting X and Y directional movement of the second block member relative to the first block member.

In another aspect of the invention each of the pair of cylindrical rods has the same length and diameter as the other cylindrical rod. Further, the elongate grooves of each of the interior surfaces of the first and second block members have a length greater than the cylindrical rods.

In another aspect of the invention the elongate grooves have depths slightly larger than the diameters of the cylindrical rods to allow the rods to rotate between stops formed by the grooves.

In another aspect of the invention the elongate grooves are positioned offset from the center of interior surfaces of the first and second block members.

Other applications of the present invention will become apparent to those skilled in the art when the following description of the best mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

Figure 1:
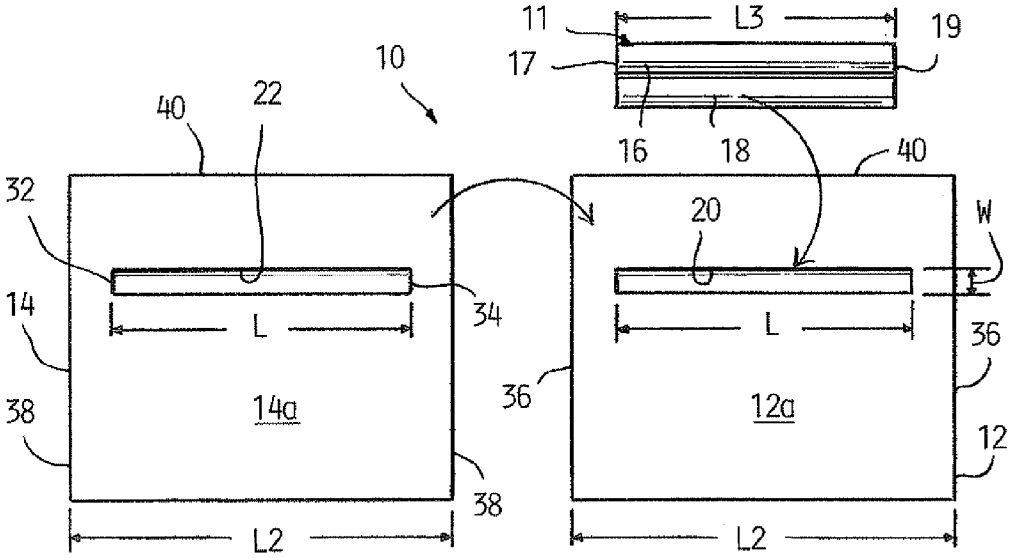
FIG. 1 is a exploded view of a pair of block members and a pair of cylindrical rods providing components of a linear sliding mechanism.

An X-Y linear slide mechanism and a method for assembling the same are disclosed herein. FIGS. 1-4 illustrate the assembly of an X-Y linear slide mechanism. The X-Y linear slide mechanism 10 includes a first block member 12 and a second block member 14. The first block member 12 defines a base plate supported on a support structure or the ground (not shown). The second block member 14 is supported on the base plate 12. The first and second block members 12 and 14 respectively are made of particular materials and sized for the particular application. The slide mechanism 10 also includes a sliding means 11 for slidably moving one of the block members 14 relative to the other block member 12 in both the X and Y directions. The sliding means 11 also supports the second member 12 on the base plate or first block member 12. In the illustrated example the sliding means 11 is pair of cylindrical rods 16 and 18 defines bearings between the two block members 12 and 14. The two cylindrical rods 16 and 18 are preferably identical having the same length and diameter and made of a material that can bear the weight of the second block member. Depending on the application, the material of the cylindrical rods 16, 18 have either insulative or conductive properties. The two cylindrical rods 16 and 18 are secured together continuously or discontinuously along their linear lengths so the two rods terminate at the same points 17, 19. The two cylinder rods 16 and 18 may be secured together by welding, adhesive, or other conventional means which will prevent relative movement between the two cylindrical rods 16, 18. FIG. 1 shows the cylindrical rods 16 and 18 welded together. The lengths of the cylindrical rods 16, 18 are less than the parallel the linear sides 32 of each of the first and second blocks 12, 14 respectively.

The base plate or first block member 12 has a planar interior surface 12*a* with an elongate groove or slot 20 formed therein. The slot width (W) is slightly larger than the diameter of the cylindrical rods 16, 18 to allow partial rotation and lineal movement of the rods 18 in the groove 20. The length (L) of the groove or slot 20 is longer than the length (L3) of the cylindrical rods 16 and 18 but shorter than the length (L2) of peripheral edges 32 of the base plate 12. The groove or slot 20 terminates before reaching the opposing peripheral edges 36 of the inner surface 12*a*. The slot 20 has a depth (D) slightly greater than the diameter of the cylindrical rod 16, 18 so that the second block member 14 can move relative to the first block member 12 when the cylinder rods 16, 18 rotate or longitudinally move along length (L) within the grooves 20, 22. The slot 20 is configured to receive one of the cylindrical rods 16, 18 and to allow longitudinal movement of the rod 16 or 18 within the confines of the slot 20. The width of the slot allows the cylinder rod 16 or 18 to rotate within slot 20 but does not allow for lateral movement of the cylinder rod 16 or 18 within the slot 20.

The second block member 14 has a planar interior surface 14*a* with a similar groove or slot 22 formed therein. The width and depth of the slot 22 are slightly greater than the diameters of the cylindrical rods 16, 18 for the same reasons mentioned supra, regarding the first block member 12. The length (L) of the slot 22 is longer than the length of the cylindrical rods 16, 18. The slot 22 also terminates before the opposing peripheral edges 38 of the interior surface 14*a*. The slot 22 is configured to receive the other of the cylindrical rods 16, 18 and to allow the rod rotatable and longitudinal movement within the confines of the slot 22 without allowing side to side lateral movement of the rod 16 or 18 within the groove 22.

Figure 2:
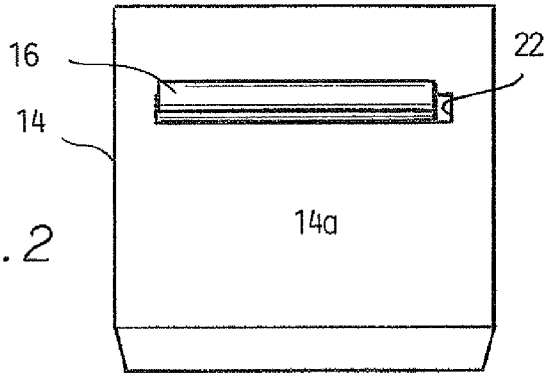
FIG. 2 is a perspective view of one of the members with the cylindrical rods disposed within a slot/groove of the block member.

FIG. 2 shows one of the cylinders 18 disposed within groove 22 of the second block member 14. The first cylinder rod 16 which is affixed to cylinder rod 18 is exposed above the slot 22, as better shown in FIG. 3. As can be seen in FIG. 2, the slot 22 is longer than the length of the rod 18 to allow for longitudinal movement of the second block member 14 relative to the cylinders 16 and 18 and also relative to the first block member 12. The slot is preferably the same length (L) as sot 22.

Figure 3:
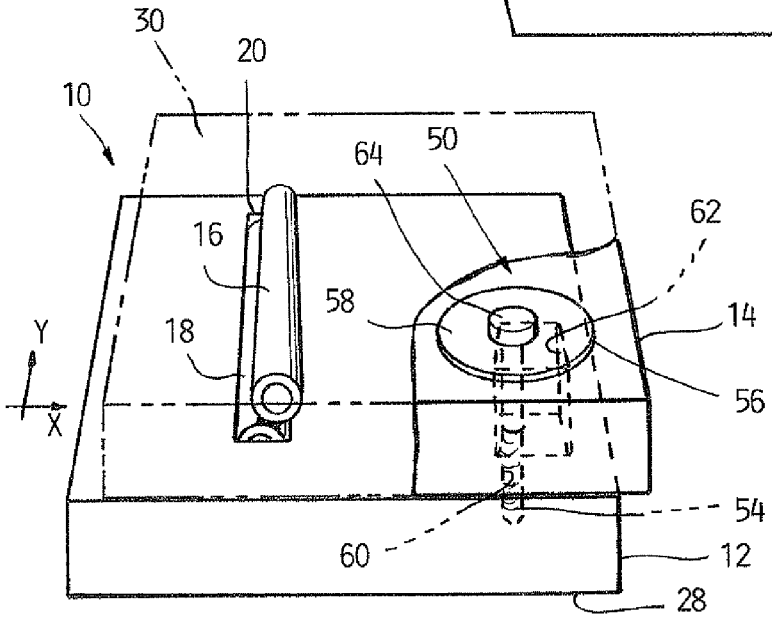
FIG. 3 is a perspective view of a first block member having the cylindrical rods disposed therein showing a second block member in phantom assembled and clamped onto the first block member with a clamping screw.
Figure 4:
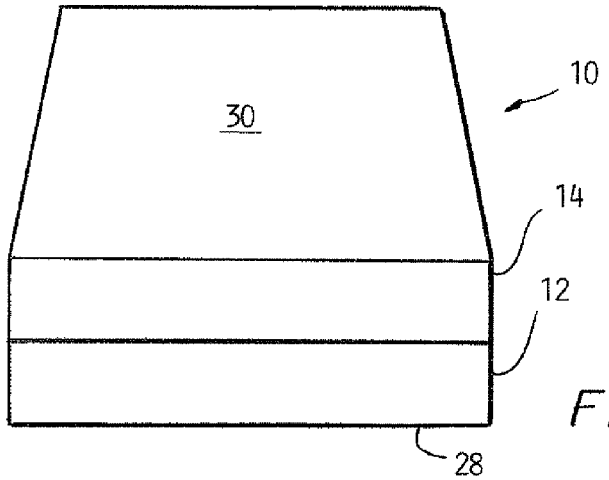
FIG. 4 is a perspective elevational view of the assembled linear slide mechanism.

To complete the assembly of the linear slide mechanism, the second block member 14 is positioned over the base plate or first block member 12 so that the slot 22 in the first block member 12 is aligned with the exposed cylinder rod 16 and so that the cylinder rod 16 is inserted within slot 22. When the slots 20, 22 and cylindrical rods 16, 18 respectively are aligned properly, the inner surfaces 12*a*, 14*a* of the pair of block members 12, 14 respectively face each other and are capable of movement relative to each other. FIG. 4 shows the linear slide mechanism 10 in its completed assembly. The cylindrical rods 16 and 18 are encapsulated within the interior grooves 20 and 22 of the pair of block members 12, 14 respectively. In the illustrated embodiment shown in FIGS. 1-3, the grooves 20, 22 are positioned offset from the direct center of the interior surfaces 12*a*, 14*a*. However, the grooves 20, 22 may be centered in the pair of block members 12, 14. Further, the grooves 20, 22 are positioned so that when the pair of cylindrical rods 16 is vertically positioned, the peripheral edges of the first and second block members 12, 14 are aligned over each other as shown in FIG. 4.

Figure 5:
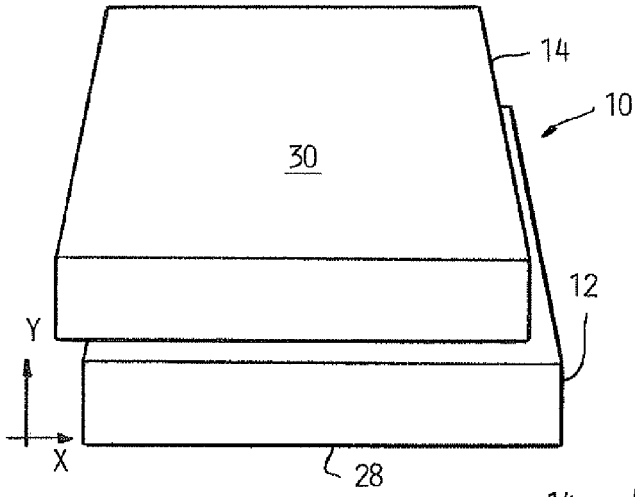
FIG. 5 is a planar view of the assembled linear slide mechanism illustrating relative movement in the X and Y direction.

Once assembled, the linear slide mechanism 10 allows for smooth motion in two directions. FIG. 5 shows the slide mechanism 10 movement in both the X and Y directions.

Figure 6:
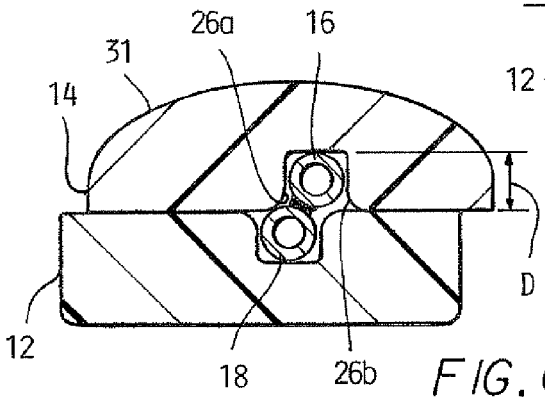
FIG. 6 is a sectional view of the assembled linear slide mechanism illustrating relative movement in the X direction.
Figure 7:
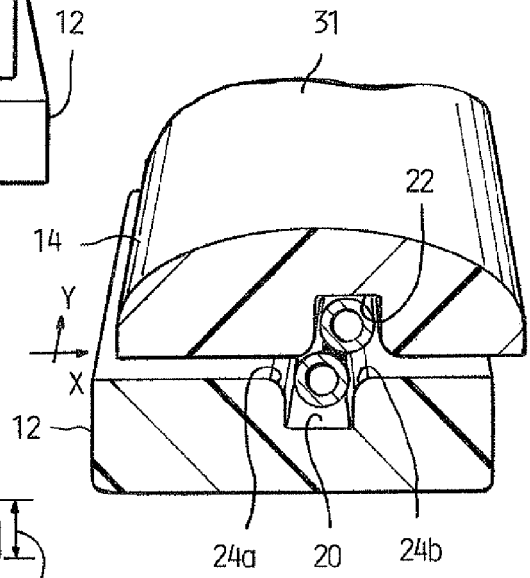
FIG. 7 is a top cutaway view of the assembled linear slide mechanism illustrating relative view in the X and Y directions.

FIGS. 6 and 7 are cutaway views of the assembled linear slide mechanism 10 to illustrate the relative movement of the cylinder rods 16 and 18 with respect to the pair of block members 12 and 14 respectively. FIGS. 6 and 7 also show that the second block member 14 can have an arcuate upper exterior surface 31. As illustrated in FIG. 7, the upper or second block member 14 can move in the Y direction relative to the first block member 12 as the pair of cylindrical rods 16, 18 moves within the confines of the length (L) of the grooves 20 and 22. The movement of the second block member 14 is limited by the length (L) of the grooves 20 and 22. The opposing lateral edges 32, 34 in groove 22 form a stop for the longitudinal movement in the Y direction of the sliding means 11 and the second block member 14.

In addition, the second block member 14 can also move in an X direction relative to the first block member 12 as shown in FIGS. 6 and 7. The movement in the X direction of the first block member 12 is limited by the angle of movement of the first cylinder rod 16 relative to the second cylinder rod 18. The movement of the second block member 14 in the Y direction is terminated when the first cylinder rod 16 comes in contact with one of the stops 24*a* or 24*b* defined by the upper edge corners of the groove 20; or when the second cylindrical rod 18 comes in contact with one of the stops 26*a* or 26*b* defined by the upper edges corners of groove 22. The upper edge corners 24*a* and 24*b*, and 26*a*, and 26*b* of the slots 20 and 22 are mitered or rounded off to permit the rotation of the first cylinder rod 16 relative to the second cylinder rod 18 for moving the first block member 14 relative to the first block member 12 in the X-direction. As can be seen in FIGS. 6 and 7, the cylindrical rods can rotate approximately 45° from the vertical position where the rod 16 is directly over rod 18.

When the first and second block members 12, 14 respectively, are positioned in their desired locations relative to each other, the block members can be clamped together to lock the block members 12, 14 in place. A clamping screw 50 for this purpose is provided as seen in FIG. 3. The clamping screw 50 includes a screw 52 with a threaded end 54 and a washer 56 with enlarged planar surface areas 58. The first block member 12 has an aperture 60 formed in the inner surface 12*a* and spaced from the groove 20. The aperture 60 has a threaded interior and sized for threadably receiving the threaded end 54 of the screw 52. The second block member 14 has a through aperture 62 having an elongate cube configuration. The screw 52 extends from the threaded aperture 60 in the first block member 12 through the aperture 62. A head 64 of the screw 52 extends above the exterior surface 30 of the second block member 14. The aperture 62 has an X-Y dimension to permit the second block member 14 to move in the X and Y directions dictated by movements of the rods 16, 18 in the grooves 20 and 22. The washer 56 is positioned between the screw head 64 and the exterior surface 30 of the second block member 14. The planar surface 58 of the washer is larger than the X-Y dimension of the aperture 62. When the block members 12, 14 are orientated in their desired positions, the screw 52 can be threaded to tighten the washer 56 against the exterior surface 30 of the second block member 14 and thereby frictionally clamp the two block members 12, 14 together.

As further can be seen in FIGS. 6 and 7, at least one of the block members 12, 14 has a planar exterior surface 28 opposing the inner surface 12*a* having the groove or slot 20. The planar surface 28 provides a planar contact for positioning on a base or surface, such as the ground, for measurement. In FIGS. 4 and 5, the second block member 14 is designated with the planar opposing surface 30. As seen in FIGS. 6 and 7, the second block member 14 may have an opposing exterior surface 31 that may be arcuate as desired for the application.

The present invention provide an easily assembled X-Y linear slide mechanism designed to allow smooth motion in two directions (X, Y) while not permitting rotational movement or movement in the Z direction of the linear slide mechanism. While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law. One such modification is that the elongate cube configuration of the aperture 62 can be replaced with a tubular configuration as long as the tubular configuration permits the X-Y movements of the second block member 14 relative to the first block member 12 dictated by the movements of the rods 16, 18 in the grooves 20, 22.

What is claimed is:

1. An X-Y linear slide mechanism comprising:

A first block member having a planar exterior surface and an opposing planar interior surface;

a second block member having a interior surface, wherein each of the planar interior surfaces have an elongate groove formed therein; and a pair of cylindrical rods secured to each other along the axial lengths and disposed within the elongate grooves, wherein the elongate grooves are configured for receiving one of the cylindrical rods, permitting X and Y directional movement of the first block member relative to the second block member.

2. The slide mechanism of claim 1, wherein each of the pair of cylindrical rods have the same length and diameter and the elongate grooves of each of the planar interior surfaces have lengths longer than the lengths of the cylindrical rods.

3. The slide mechanism of claim 2, wherein the elongate grooves have depths configured to permit rotational and longitudinal movement of the rods.

4. The slide mechanism of claim 2, wherein the interior surface of the first block member faces the interior surface of the second block member when assembled.

5. The slide mechanism of claim 2, wherein the elongate grooves terminate at a location spaced from the peripheral edges of first and second block members.

6. The slide mechanism of claim 1, wherein the elongate groove are positioned offset from the center of the interior surfaces of the first and second block members.

7. The slide mechanism of claim 1, wherein at least one elongate groove has a length longer than the length of the pair of cylindrical rods.

8. The slide mechanism of claim 1, wherein upper edges of each of the elongate grooves has mitered edges.

9. The slide mechanism of claim 1, further comprising a clamping screw to lock the first and second block members together, said clamping screw including a screw and a washer.

10. The slide mechanism of claim 9 wherein the first block member has a threaded aperture for receiving a threaded end of the screw and the second block member has a through aperture with an elongate cube configuration for receiving a portion of the screw.

11. The slide mechanism of claim 10, wherein the elongate cube configuration is configured to permit movement of the second block member in the X and Y directions dictated by the movements of the pair of cylindrical rods within the elongate grooves.

12. The slide mechanism of claim 10, wherein the washer has a planar surface larger than the X-Y dimension of the through aperture in the second block member.

* * * * *